US009850725B2

(12) United States Patent
Moreno et al.

(10) Patent No.: US 9,850,725 B2
(45) **Date of Patent: *Dec. 26, 2017**

(54) ONE TRIP INTERVENTIONLESS LINER HANGER AND PACKER SETTING APPARATUS AND METHOD

(71) Applicant: BAKER HUGHES INCORPORATED, Houston, TX (US)

(72) Inventors: Mario Moreno, Spring, TX (US); James M. Fraser, Spring, TX (US); Sidney K. Smith, Jr., Conroe, TX (US); Abbie J. Palmieri, Houston, TX (US); Daniel C. Ewing, Katy, TX (US); Matthew J. Kruger, Spring, TX (US); Eric Halfman, Magnolia, TX (US); Jarandon J. Adams, Spring, TX (US)

(73) Assignee: Baker Hughes, a GE company, LLC, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/687,407

(22) Filed: Apr. 15, 2015

(65) Prior Publication Data

US 2016/0305206 A1 Oct. 20, 2016

(51) Int. Cl.
*E21B 23/00* (2006.01)
*E21B 23/04* (2006.01)
(Continued)

(52) U.S. Cl.
CPC ..... *E21B 23/00* (2013.01); *E21B 23/04* (2013.01); *E21B 23/06* (2013.01); *E21B 33/14* (2013.01); *E21B 43/10* (2013.01); *E21B 47/122* (2013.01)

(58) Field of Classification Search
CPC ..... E21B 23/00; E21B 23/04; E21B 23/06; E21B 43/10
See application file for complete search history.

(56) References Cited

U.S. PATENT DOCUMENTS 3,264,994 A 8/1966 Leutwyler
3,527,296 A 9/1970 Malone
(Continued)

FOREIGN PATENT DOCUMENTS

WO 9315306 8/1993
WO 0177480 10/2001
(Continued)

*Primary Examiner* — Matthew R Buck
*Assistant Examiner* — Aaron Lembo
(74) *Attorney, Agent, or Firm* — Steve Rosenblatt

(57) ABSTRACT

A liner hanger and packer are set at different times in a single trip without intervention. The running tool has a ball seat that accepts a ball for pressuring up which results in movement of a mandrel with a magnet mounted to it past a valve triggered by the magnetic field. Potential energy is released to set the liner hanger. Further mandrel movement then releases the running tool once the liner is supported by the hanger. After a cement job that starts with confirmation of release of the running tool, the same magnet is moved past another valve adjacent the liner top packer. Another valve is triggered open to release potential energy and move parts that set the packer. The running tool is removed from the liner and brought to the surface.

19 Claims, 14 Drawing Sheets

(51) Int. Cl.

| | |
|---|---|
| ***E21B 23/06*** | (2006.01) |
| ***E21B 43/10*** | (2006.01) |
| ***E21B 33/14*** | (2006.01) |
| ***E21B 47/12*** | (2012.01) |

(56) References Cited

U.S. PATENT DOCUMENTS

| | | | | |
|---|---|---|---|---|
| 3,754,597 | A | 8/1973 | Garrett | |
| 4,776,396 | A | 10/1988 | Studholme | |
| 5,086,853 | A | 2/1992 | Evans | |
| 5,101,904 | A | 4/1992 | Gilbert | |
| 5,188,183 | A | 2/1993 | Hopmann et al. | |
| 5,226,494 | A * | 7/1993 | Rubbo | E21B 23/00 166/250.17 |
| 5,447,702 | A | 9/1995 | Campbell et al. | |
| 5,544,705 | A | 8/1996 | Jones | |
| 5,810,082 | A | 9/1998 | Jordan, Jr. | |
| 6,173,786 | B1 | 1/2001 | Sampson et al. | |
| 6,354,374 | B1 | 3/2002 | Edwards et al. | |
| 6,359,569 | B2 | 3/2002 | Beck et al. | |
| 6,364,037 | B1 | 4/2002 | Brunnert et al. | |
| 6,481,505 | B2 | 11/2002 | Beck et al. | |
| 6,497,280 | B2 | 12/2002 | Beck et al. | |
| 6,588,505 | B2 | 7/2003 | Beck et al. | |
| 6,624,759 | B2 | 9/2003 | Tubel et al. | |
| 6,851,481 | B2 | 2/2005 | Vinegar et al. | |
| 6,877,564 | B2 | 4/2005 | Layton et al. | |
| 7,108,073 | B2 | 9/2006 | Patel | |
| 7,216,713 | B2 | 5/2007 | Read et al. | |
| 7,237,616 | B2 | 7/2007 | Patel | |
| 7,252,152 | B2 | 8/2007 | LoGiudice et al. | |
| 7,318,471 | B2 | 1/2008 | Rodney et al. | |
| 7,367,405 | B2 | 5/2008 | Murray | |
| 7,438,130 | B2 | 10/2008 | Read, Jr. et al. | |
| 7,503,398 | B2 | 3/2009 | LoGiudice et al. | |
| 7,562,712 | B2 | 7/2009 | Cho et al. | |
| 7,591,319 | B2 | 9/2009 | Xu | |
| 7,604,062 | B2 | 10/2009 | Murray | |
| 7,665,527 | B2 | 2/2010 | Loretz | |
| 7,730,954 | B2 | 6/2010 | Schultz et al. | |
| 7,775,283 | B2 | 8/2010 | Coronado et al. | |
| 7,806,179 | B2 | 10/2010 | Coronado et al. | |
| 7,819,198 | B2 | 10/2010 | Birckhead et al. | |
| 7,836,956 | B2 | 11/2010 | Smithson et al. | |
| 7,866,406 | B2 | 1/2011 | Mackenzie | |
| 7,926,575 | B2 | 4/2011 | Ringgenberg et al. | |
| 7,971,651 | B2 | 7/2011 | Tanju et al. | |
| 8,162,066 | B2 | 4/2012 | Farmer et al. | |
| 8,813,857 | B2 | 8/2014 | Mills et al. | |
| 2004/0060704 | A1 | 4/2004 | Layton et al. | |
| 2004/0226720 | A1 | 11/2004 | Schultz et al. | |
| 2004/0256113 | A1 | 12/2004 | Logiudice et al. | |
| 2005/0133220 | A1 | 6/2005 | Bishop | |
| 2005/0284625 | A1 | 12/2005 | Rodney et al. | |
| 2007/0089911 | A1 | 4/2007 | Moyes et al. | |
| 2007/0289473 | A1 | 12/2007 | Bussear | |
| 2008/0023229 | A1 | 1/2008 | Richards et al. | |
| 2008/0149323 | A1 | 6/2008 | O'Malley et al. | |
| 2008/0149350 | A1 | 6/2008 | Cochran et al. | |
| 2008/0236819 | A1 | 10/2008 | Foster et al. | |
| 2009/0038802 | A1 | 2/2009 | Lucas | |
| 2009/0050373 | A1 | 2/2009 | Loretz | |
| 2009/0071654 | A1 | 3/2009 | O'Malley et al. | |
| 2009/0139722 | A1 | 6/2009 | Bussear et al. | |
| 2009/0139822 | A1 | 6/2009 | Yoo | |
| 2009/0229832 | A1 | 9/2009 | King | |
| 2010/0071912 | A1 | 3/2010 | Mackenzie | |
| 2010/0126711 | A1 | 5/2010 | Buss et al. | |
| 2010/0200244 | A1* | 8/2010 | Purkis | E21B 34/066 166/373 |
| 2010/0200245 | A1 | 8/2010 | Ringgenberg et al. | |
| 2010/0243232 | A1* | 9/2010 | Zimmerman | E21B 33/129 166/66.5 |
| 2010/0243269 | A1 | 9/2010 | Solhaug et al. | |
| 2011/0168403 | A1 | 7/2011 | Patel | |
| 2011/0284240 | A1 | 11/2011 | Chen et al. | |
| 2012/0211221 | A1 | 8/2012 | Mills et al. | |
| 2012/0211245 | A1 | 8/2012 | Fuhst et al. | |
| 2013/0014941 | A1 | 1/2013 | Tips et al. | |
| 2013/0020092 | A1 | 1/2013 | Ramon et al. | |
| 2013/0048308 | A1 | 2/2013 | Lehr et al. | |
| 2013/0186645 | A1* | 7/2013 | Hall | E21B 23/00 166/382 |
| 2013/0264051 | A1* | 10/2013 | Kyle | E21B 41/00 166/244.1 |
| 2013/0284432 | A1* | 10/2013 | MacPhail | E21B 47/14 166/250.01 |
| 2014/0008083 | A1* | 1/2014 | Ring | E21B 23/06 166/382 |
| 2014/0144653 | A1 | 5/2014 | Mills et al. | |
| 2014/0305662 | A1* | 10/2014 | Giroux | E21B 33/14 166/386 |
| 2015/0136393 | A1* | 5/2015 | Turley | E21B 43/10 166/285 |
| 2016/0047189 | A1* | 2/2016 | MacLeod | E21B 23/06 166/377 |
| 2016/0102512 | A1* | 4/2016 | Nguyen | E21B 23/02 166/379 |

FOREIGN PATENT DOCUMENTS

| | | |
|---|---|---|
| WO | 2004018833 | 3/2004 |
| WO | 2007036722 | 4/2007 |

* cited by examiner

ONE TRIP INTERVENTIONLESS LINER HANGER AND PACKER SETTING APPARATUS AND METHOD

FIELD OF THE INVENTION

The field of the invention is actuators and actuation methods for operating a subterranean tool and more particularly actuation of a too disposed about a tubular without a wall opening in the tubular using potential energy in the actuator.

BACKGROUND OF THE INVENTION

Many operations in a subterranean borehole involve the setting of took that are mounted outside of a tubular string. A common example is a packer or slips that can be used to seal an annular space or/and support a tubular string from another. Prior mechanical actuation techniques for such devices, which used applied or hydrostatic pressure to actuate a piston to drive slips up cones and compress sealing elements into a sealing position, involved openings in the tubular wall. These openings are considered potential leak paths that reduce reliability and are not desirable.

Alternative techniques were developed that accomplished the task of tool actuation without wall openings. These devices used annular fluid that was selectively admitted into the actuator tool housing and as a result of such fluid entry a reaction ensued that created pressure in the actuator housing to operate the tool. In one version the admission of water into a portion of the actuator allowed a material to be reacted to create hydrogen gas which was then used to drive a piston to set a tool such as a packer. Some examples of such tools that operate with the gas generation principle are U.S. Pat. No. 7,591,319 and US Publications 2007/0089911 and 2009/0038802.

These devices that had to generate pressure downhole were complicated and expensive. In some instances the available space was restricted for such devices limiting their feasibility. U.S. Pat. No. 8,813,857 shows an actuator that goes in the hole, with stored potential energy that employs a variety of signaling techniques from the surface to actuate the tool and release the setting pressure/force. The preferred potential energy source is compressed gas. This design incorporated a magnet dropped or pumped into the borehole that communicated with a valve to initialize the pressure generation step to actuate the tool due to valve operation. This design required multiple deliveries of wiper plugs with magnets for actuation of more than a single tool. In the case of a liner hanger and liner top packer that is to be set after a cement job with the liner hanger already set, the design in this reference would require multiple darts which creates some uncertainty that the darts would reach their destination and actuate the respective tools. The present invention delivers multiple tools that need to be set at different times with a running tool that contains the trigger for actuation so that in a single trip multiple tools can be set in one trip into the hole at different times without wall openings in the tubular. Those skilled in the art will further understand the invention from a review of the description of the preferred embodiment and the associated drawings while further appreciating that the full scope of the invention is to be determined by the appended claims.

SUMMARY OF THE INVENTION

A liner hanger and packer are set at different times in a single trip without intervention. The running tool has a ball seat that accepts a ball for pressuring up which results in movement of a mandrel with a magnet mounted to it past a valve triggered by the magnetic field. Potential energy is released to set the liner hanger. Further mandrel movement then releases the running tool once the liner is supported by the hanger. After a cement job that starts with confirmation of release of the running tool, the same magnet is moved past another valve adjacent the liner top packer. Another valve is triggered open to release potential energy and move parts that set the packer. The running tool is removed from the liner and brought to the surface.

DETAILED DESCRIPTION OF THE PREFERRED EMBODIMENT

Figure 2C:
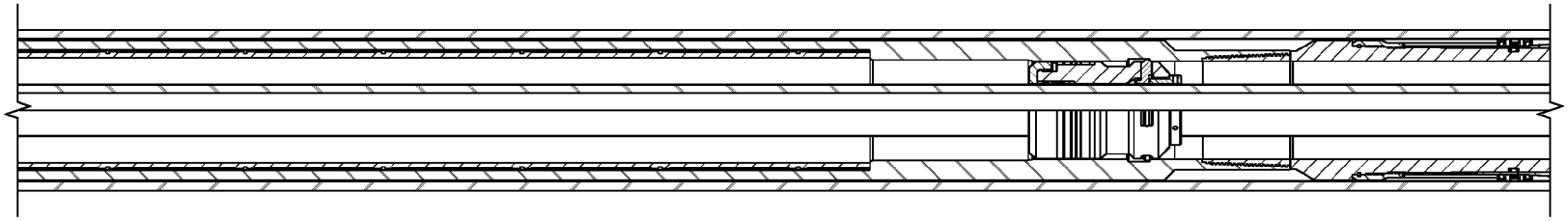
Figure 2D:
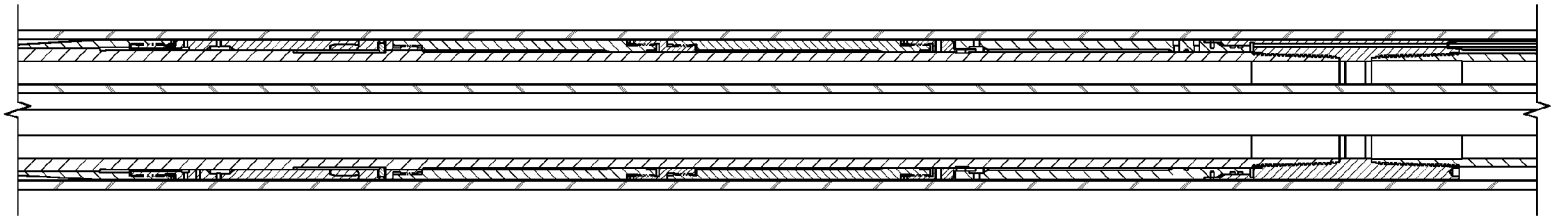
Figure 2E:
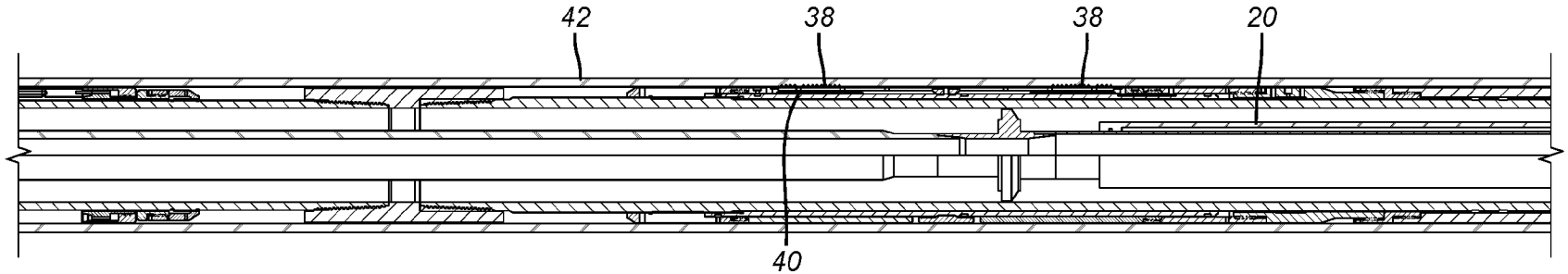
Figure 2F:
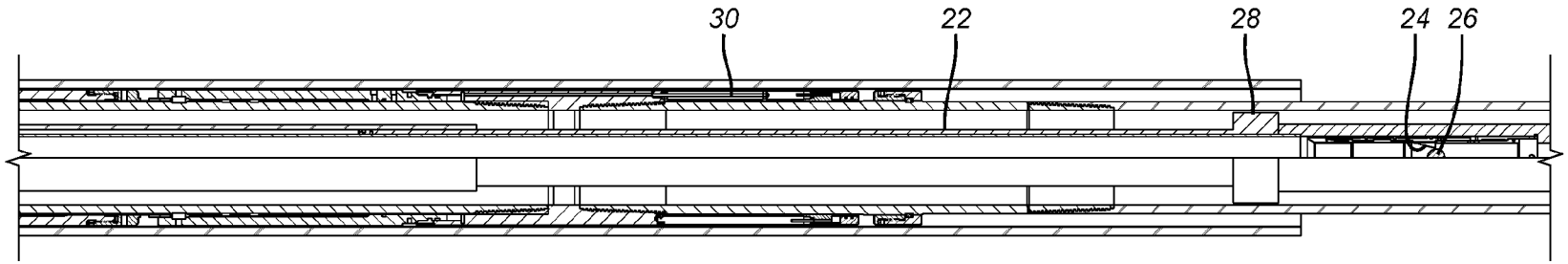
Figure 3F:
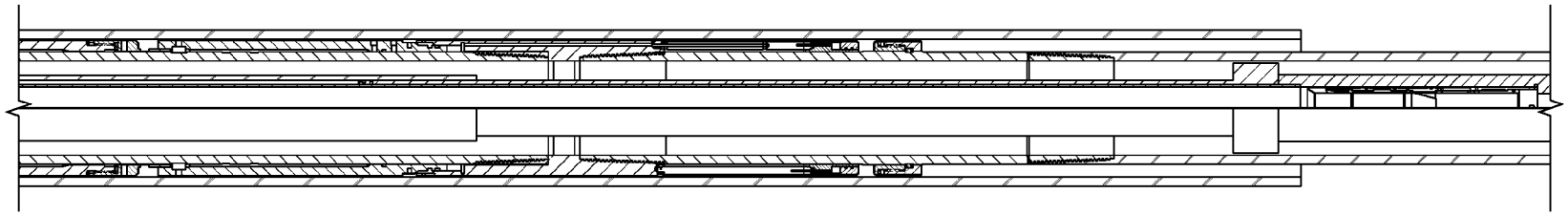
Figure 1G:
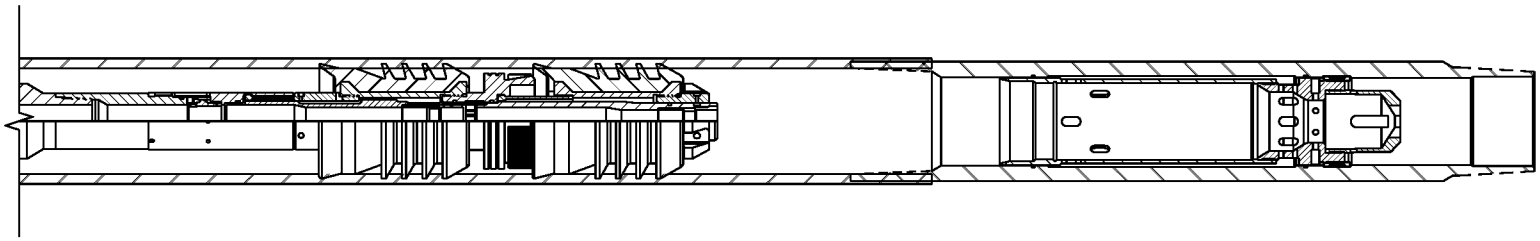
Figure 2G:
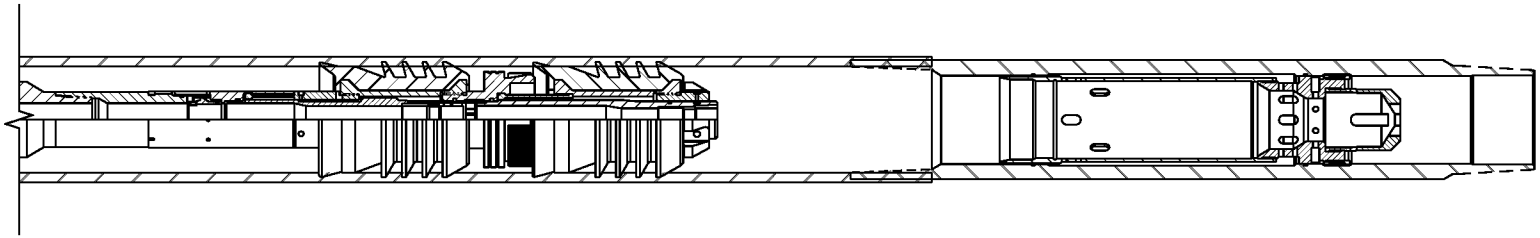
Figure 3G:
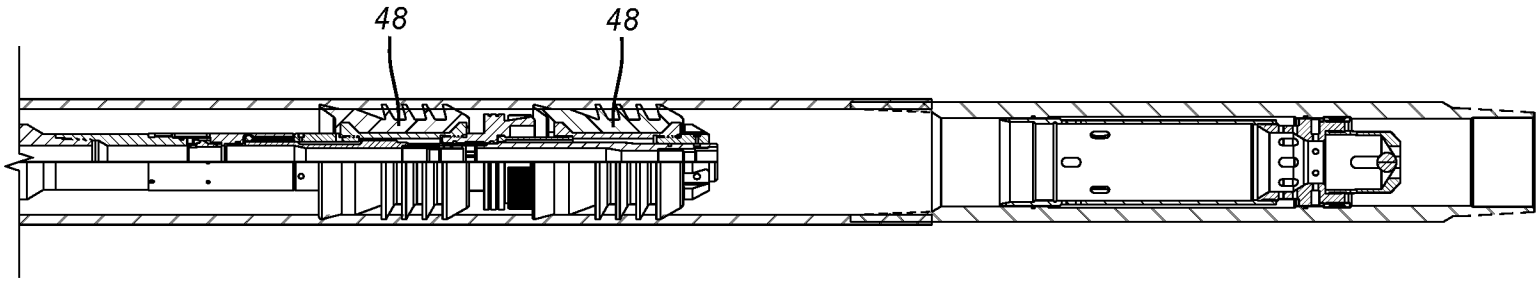
Figure 4A:
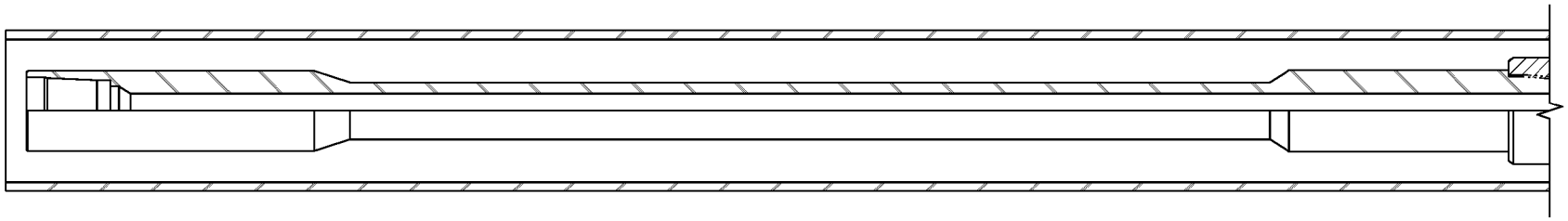
FIGS. 4*a*-4*g* show the wiper plugs released depicting the condition at the end of cementing.
Figure 4B:
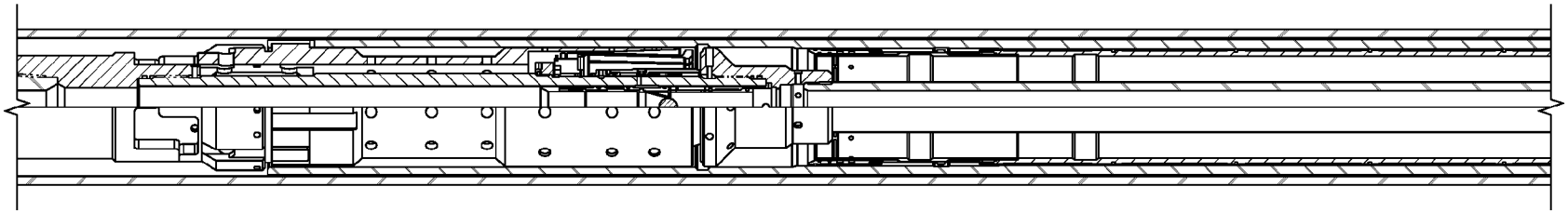
Figure 4C:
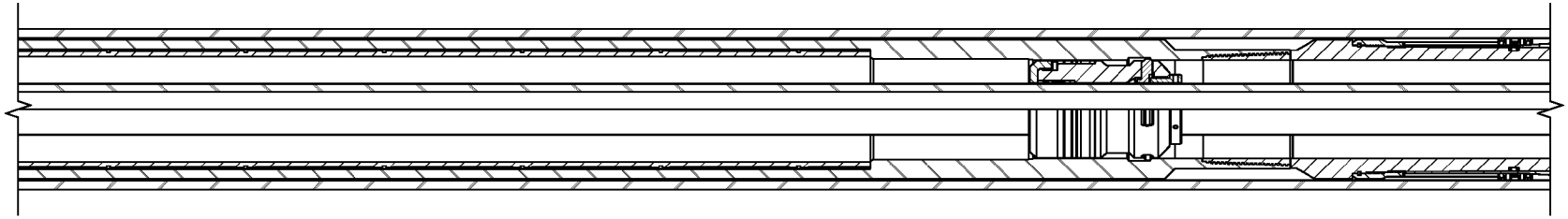
Figure 4D:
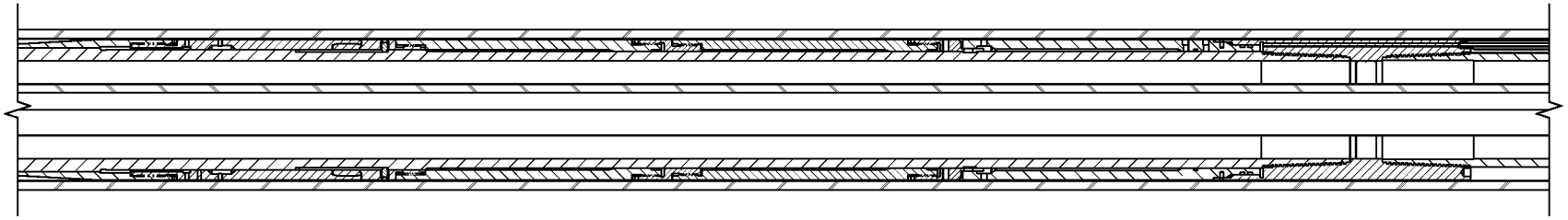

Referring to FIGS. 1*a*-1*g* a liner 10 has no wall penetrations and is supported by a running tool 12 at dogs 14 that extend into grooves 16 in the liner 10. The running tool 12 is in turn supported from a remote location by a running string 15 to position liner 10 at a predetermined borehole location. The running tool 12 has a mandrel 18 and telescoping components 20 and 22 near a lower end thereof. Component 22 has a seat 24 that accepts a ball 26 as shown in FIG. 2*f*. Pressure on seat ball 26 extends component 22 out from component 20 with the result that a magnet 28 moves past a sensor package 30 that is activated by the field moving past it as a result of axial movement of magnet 28. The result of getting a signal allows the package 30 to open a valve (not shown) to the annulus pressure. A piston assembly 36 defines low pressure chambers 32 and 34 such that on opening of the valve that is not shown a net uphole force is created on the piston assembly 36 to drive slips 38 up a ramp 40 and into the wall of the surrounding tubular 42.

Figure 1A:
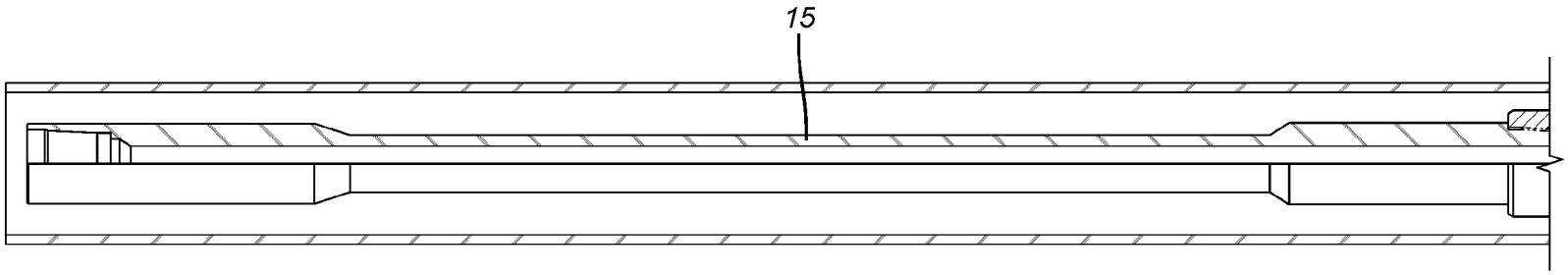
FIGS. 1*a*-1*g* show the liner supported by a running tool in the run in position.
Figure 2A:
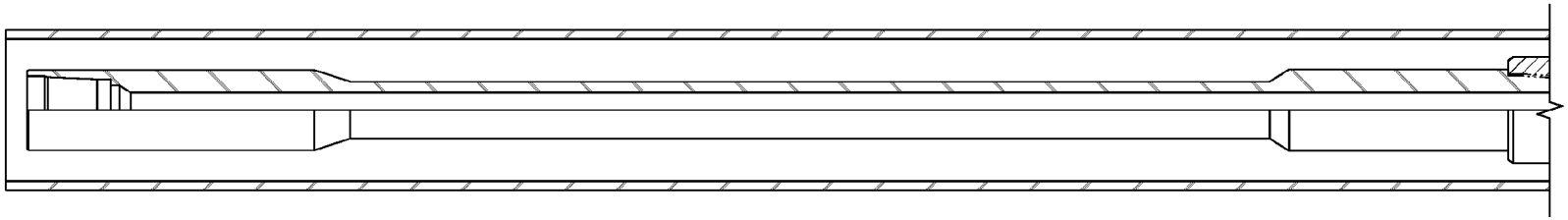
FIGS. 2*a*-2*g* show the liner hanger set.
Figure 3A:
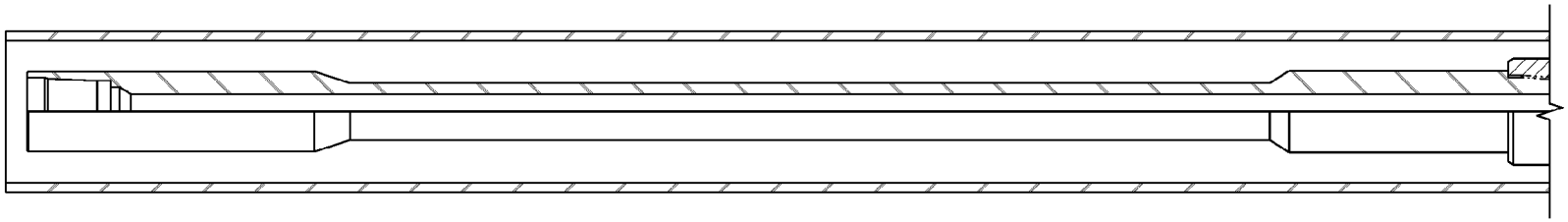
FIGS. 3*a*-3*g* show the running tool released.
Figure 1B:
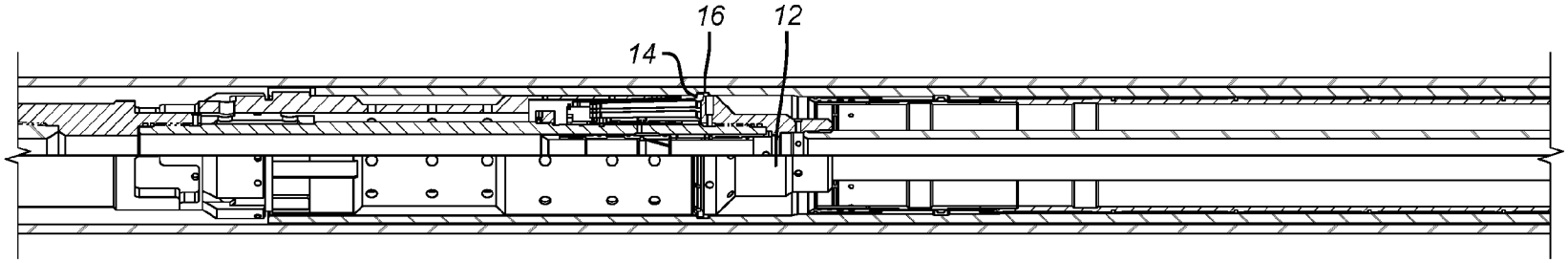
Figure 2B:
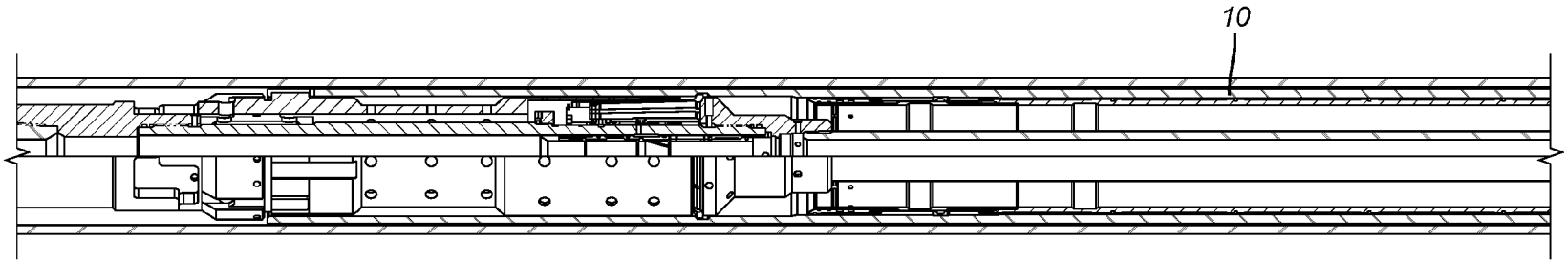
Figure 3B:
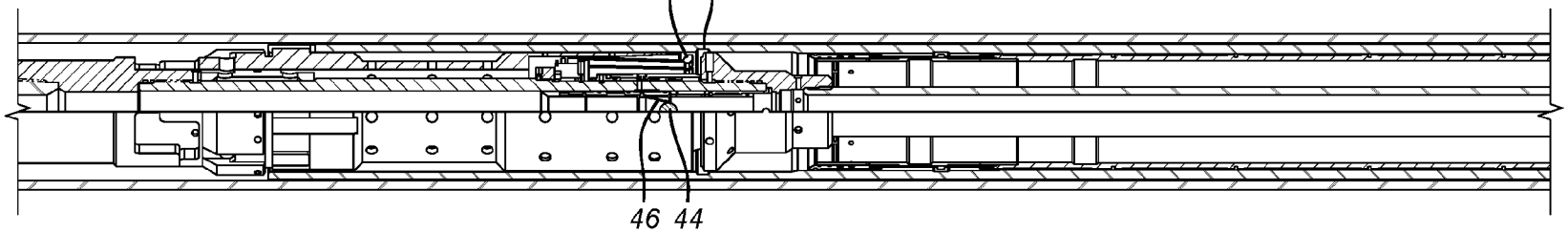
Figure 1C:
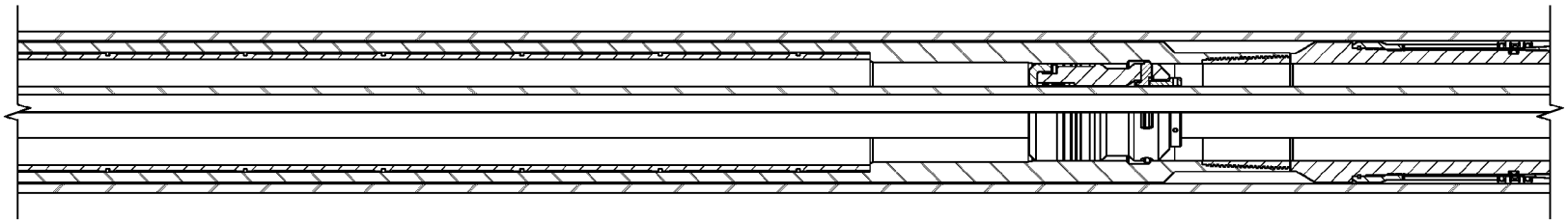
Figure 3C:
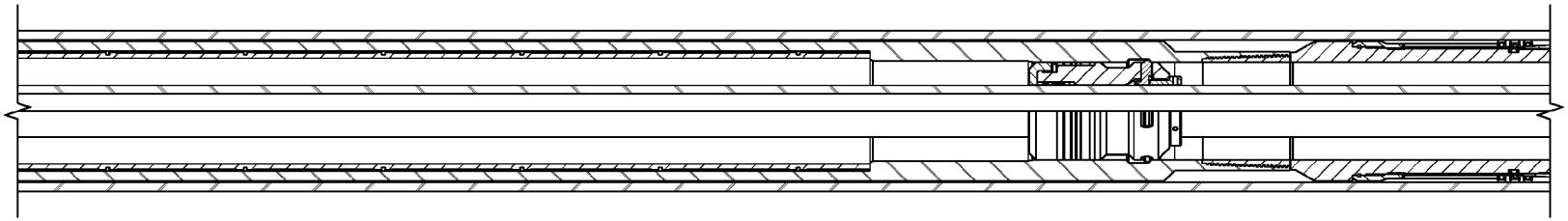
Figure 1D:
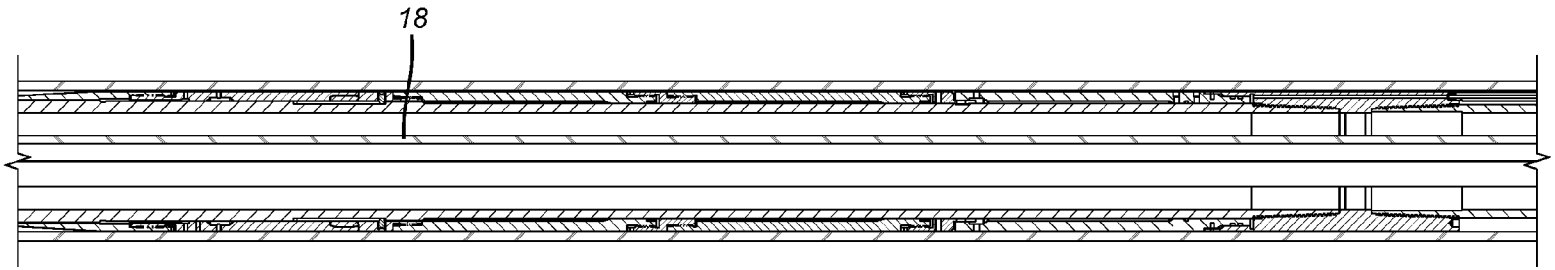
Figure 3D:
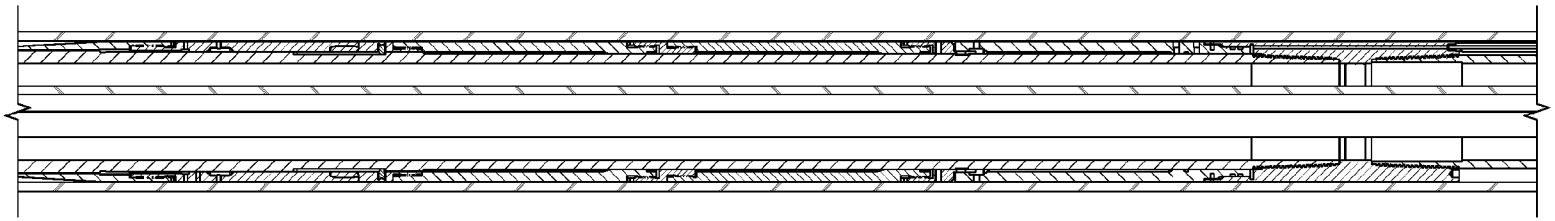
Figure 1E:
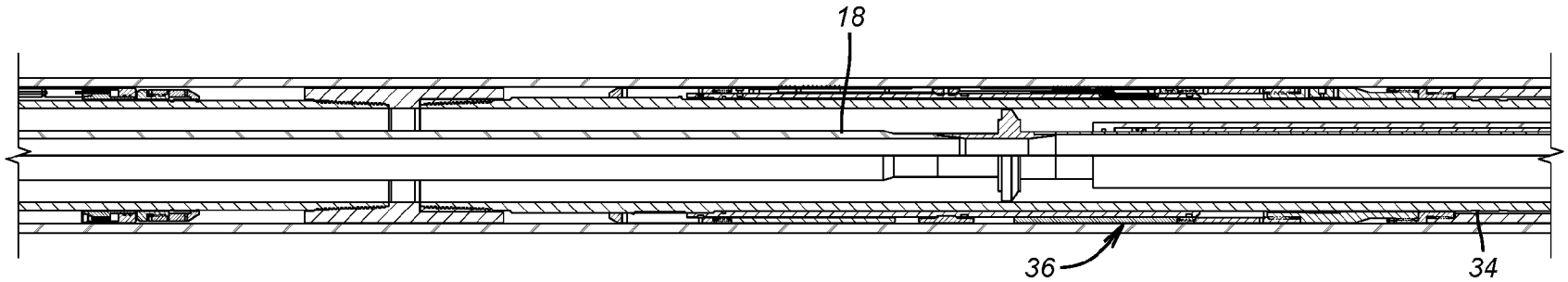
Figure 3E:
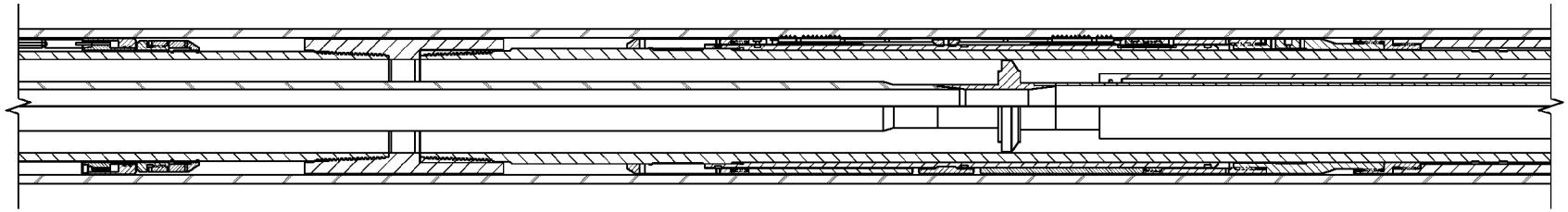
Figure 1F:
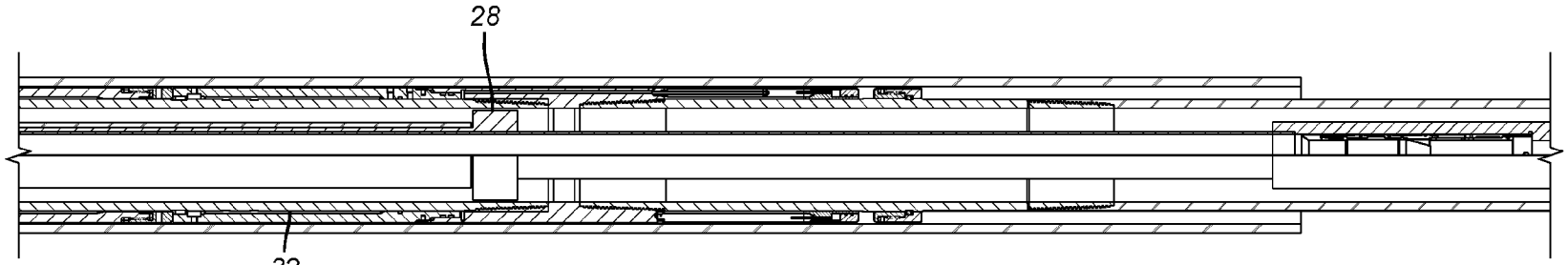
Figure 4F:
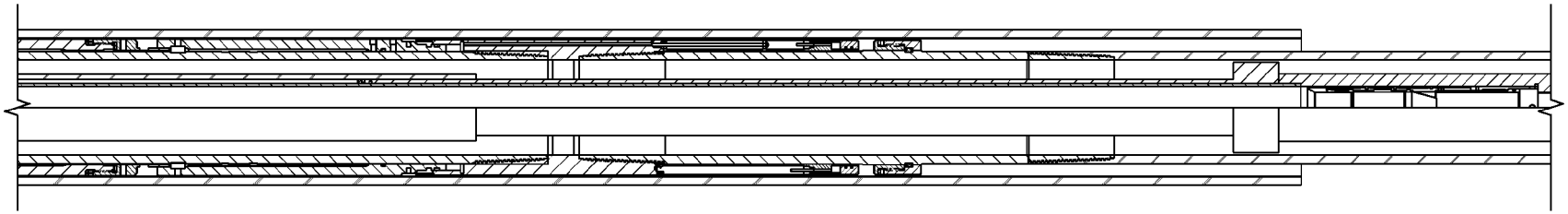
Figure 4G:
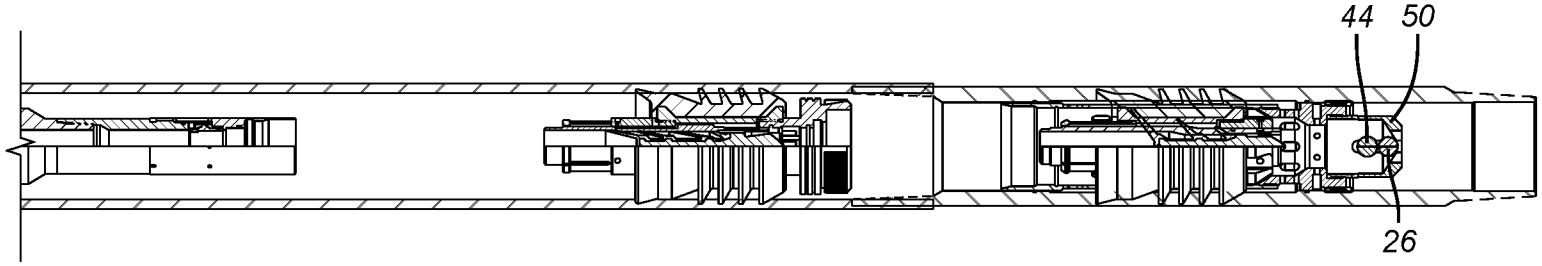
Figure 5G:
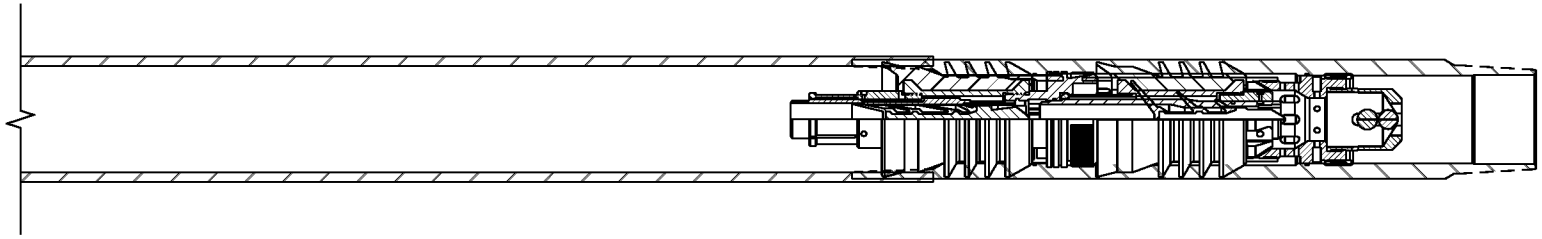

At this point a larger ball 44 is dropped onto a seat 46 in the running tool 12 as shown in FIG. 3*b*. Pressure is applied to shift a sleeve to release the dogs 14 out of the grooves 16 so that the running tool 12 is released from the surrounding tubular 42. The actuation of the slips 38 into the surrounding tubular 42 now supports the liner 10. The running tool 12 can now be picked up to ensure that it has fully released from the liner 10 before cement is delivered in a known manner and the leading and trailing wiper plugs 48 are released to push the cement into an annular space that is not shown that surrounds the liner 10 in the borehole also in a known manner as shown in FIG. 4*g*. It should be noted that balls 26 and 44 get blown out through their respective seats into a ball catcher 50.

Figure 5A:
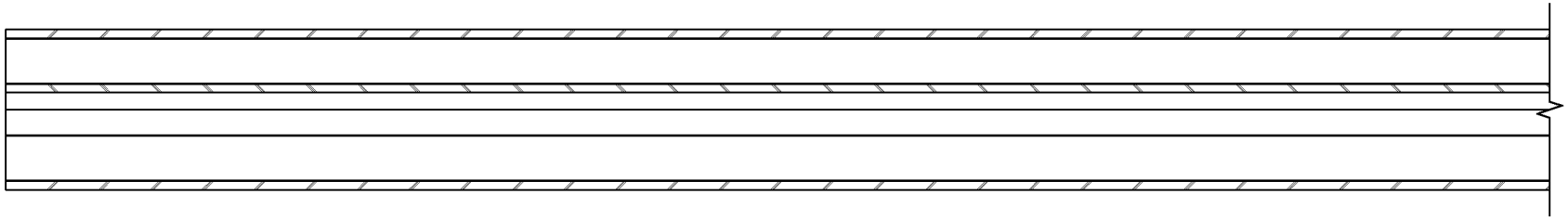
FIGS. 5*a*-5*g* show the setting of the liner packer with further movement of the running tool.
Figure 5B:
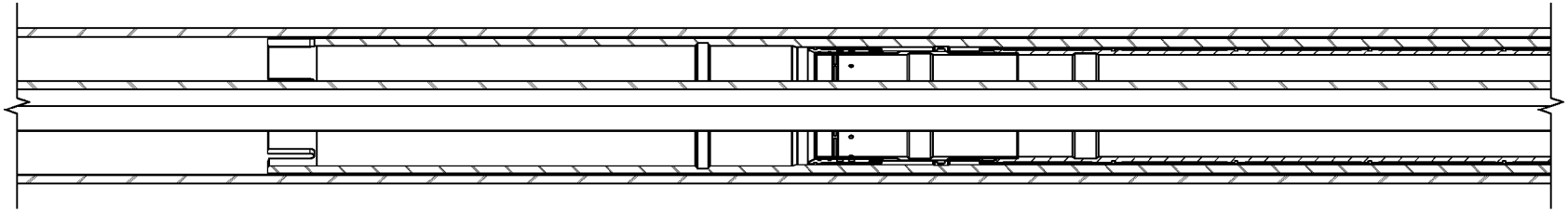
Figure 5C:
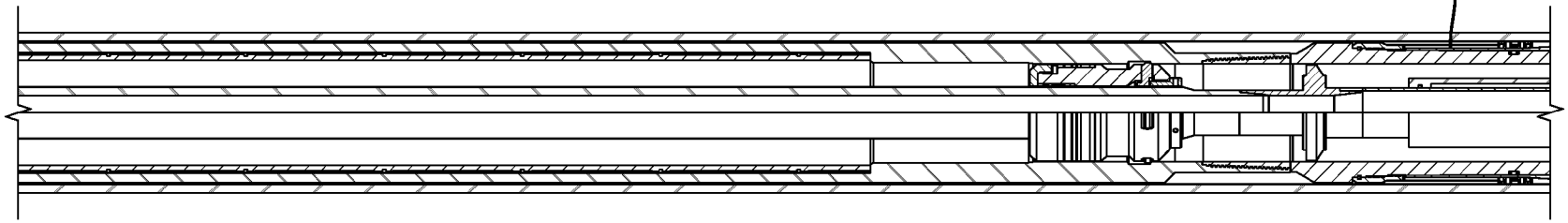
Figure 5D:
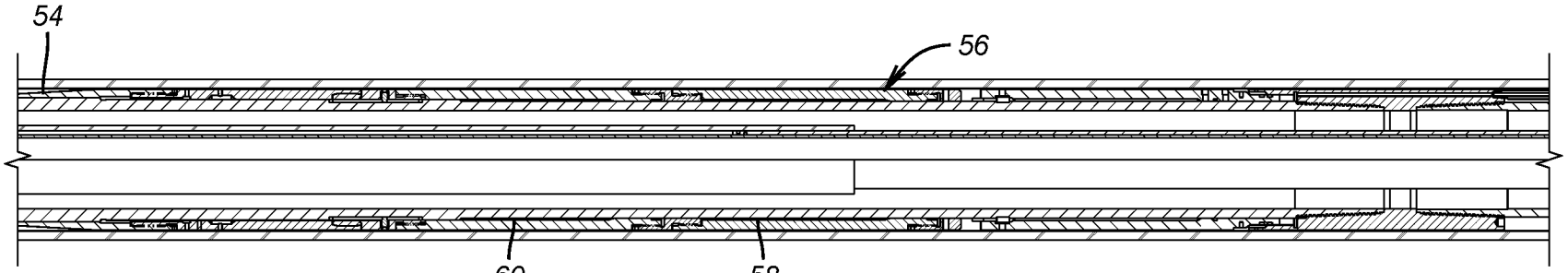
Figure 4E:
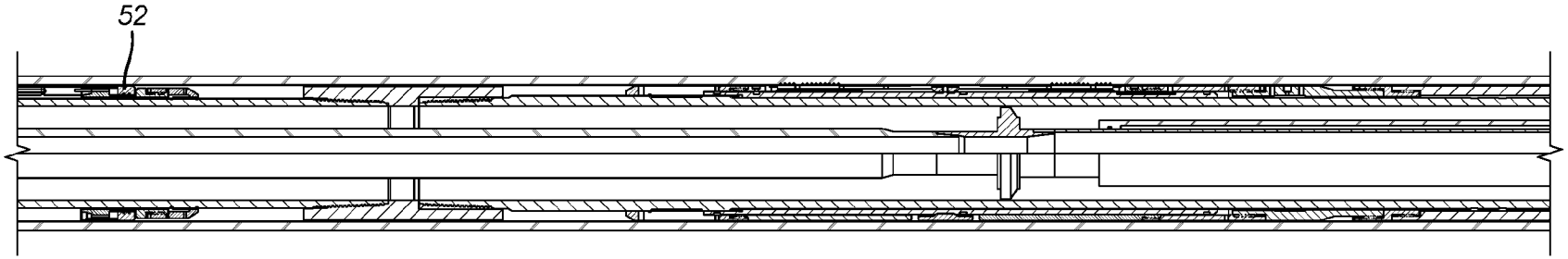
Figure 5E:
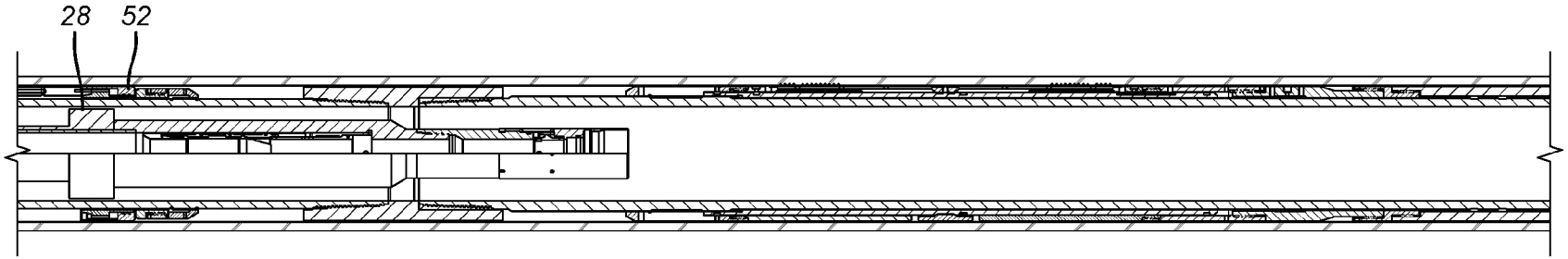
Figure 5F:
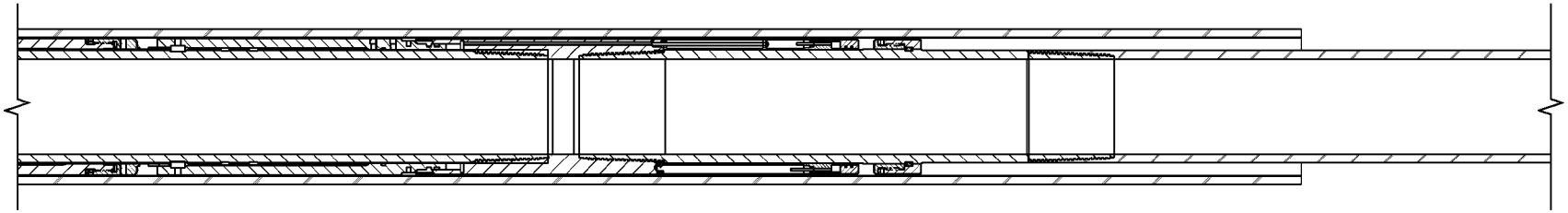

After the cementing is completed and it is time to set the packer 54 the magnet 28 is picked up with the running tool 12 as shown in FIG. 5*d*-*e* so that a sensor package 52 identical to the sensor package 30 is triggered to open a second valve that is not shown. Here again a net force results on a piston assembly 56 that defines chambers 58 and 60 initially at low pressure. As before with setting the hanger slips 38 the opening of the second valve puts an unbalanced force on the piston assembly 56 that breaks shear pins and releases dogs that allow movement of the piston assembly 56 in an uphole direction to compress the packer 54 into a sealing position against the surrounding tubular 42. At this point the running tool can be pulled out of the hole.

Those skilled in the art will now appreciate that the present invention associates a signal device with the running tool and allows an initial movement to set a first tool, which in the preferred embodiment is a liner hanger. Subsequent movements of the running tool in the same trip then sets another tool, which in the preferred embodiment is a liner top packer. While the source of potential energy is described as using hydrostatic pressure or applied pressure on top of hydrostatic in the surrounding annulus, other pressure sources can be deployed for piston movement. For example, a reaction that generates gas as a result of valve opening can be the source of potential energy to set one or more pistons to operate tools in sequence. It should be noted that the liner has no wall openings that can present potential leak paths. While a magnetic field is preferred in the described embodiment, other triggering signals are contemplated such as vibratory, acoustic or mud pulses to name a few. The invention allows in a single trip the setting of multiple tools with a single triggering source that is sequentially brought into proximity with signal receivers to trigger a movement that applies force to a piston to set multiple tools sequentially without well bore intervention. In the preferred embodiment the triggering source is on a running tool for the tools ultimately set with the movement of the running tool that eventually comes out of the hole.

The above description is illustrative of the preferred embodiment and many modifications may be made by those skilled in the art without departing from the invention whose scope is to be determined from the literal and equivalent scope of the claims below:

We claim:

1. A method of operating multiple tools with actuators therefor at a subterranean location, comprising:

running in, to a predetermined subterranean location, a tubular string on a running tool, said running tool connected adjacent a lower end of a running string;

mounting the multiple tools and actuators therefor exterior to said tubular string for said running in;

mounting a triggering device on said running tool for said running in, sequentially setting said multiple tools with said triggering device with movement of said running tool relative to the tubular string, a first of said tools being set while said tubular string is supported by said running tool;

releasing from said tubular string and removing said running tool and running string from the subterranean location.

2. The method of claim 1, comprising:

moving said triggering device with respect to said tubular string to actuate the first of said tools.

3. The method of claim 2, comprising:

mounting said triggering device on a telescoping component of said running tool.

4. The method of claim 3, comprising:

moving said triggering device longitudinally with applied pressure to said telescoping component.

5. The method of claim 1, comprising:

releasing from said tubular string and removing said running tool and running string from the subterranean location;

moving said running tool with said running string after setting the first of said tools and after said releasing from said tubular string to set a second of said tools.

6. The method of claim 5, comprising:

setting said first and second tools with discrete longitudinal movements of said triggering device.

7. The method of claim 6, comprising:

mounting said triggering device on a telescoping component of said running tool.

8. The method of claim 7, comprising:

moving said telescoping component relative to said tubular string to set the first of said tools with internal pressure in said running tool.

9. The method of claim 8, comprising:

making said first of said tools a hanger for said tubular string.

10. The method of claim 9, comprising:

making a second of said tools a packer for said tubular string.

11. The method of claim 10, comprising:

using a magnet as said triggering device.

12. The method of claim 1, comprising:

employing a magnet as said triggering device.

13. The method of claim 1, comprising:

employing hydrostatic pressure available at the subterranean location to selectively drive discrete pistons that comprise said actuators to set the first and a second of said multiple tools.

14. A method of operating multiple tools with actuators therefor at a subterranean location, comprising:

running in, to a predetermined subterranean location, a tubular string on a running tool, said running tool connected adjacent a lower end of a running string;

mounting the multiple tools and actuators therefor exterior to said tubular string for said running in;

mounting a triggering device on said running tool for said running in;

sequentially setting said multiple tools with said triggering device with movement, of said running tool relative to the tubular string triggering at least one of said multiple tools to set;

moving said triggering device with respect to said tubular string to actuate a first of said tools;

continuing to support said tubular string with said running tool when actuating said first of said tools;

releasing from said tubular string and removing said running tool and running string from the subterranean location;

mounting said triggering device on a telescoping component of said running tool;

moving said triggering device longitudinally with applied pressure to said telescoping component;

landing an object on a seat to allow pressure buildup to move said telescoping component.

15. The method of claim 14, comprising:

selectively blocking a passage in said running tool;

building pressure in said running tool to release said running tool from said tubular string when said tubular string is supported due to setting of said first tool.

16. The method of claim 15, comprising:

dropping a second object on a second seat in said running tool for said selectively blocking;

blowing out said object and said second object into a catcher at a lower end of said tubular string.

17. A method of operating multiple tools with actuators therefor at a subterranean location, comprising:

running in, to a predetermined subterranean location, a tubular string on a running tool, said running tool connected adjacent a lower end of a running string;

mounting the multiple tools and actuators therefor exterior to said tubular string for said running in;

mounting a triggering device on said running tool for said running in;

sequentially setting said multiple tools with said triggering device with movement of said running tool relative to the tubular string triggering at least one of said multiple tools to set;

releasing from said tubular string and removing said running tool and running string from the subterranean location;

employing hydrostatic pressure available at the subterranean location to selectively drive discrete pistons that comprise said actuators to set a first and second of said multiple tools;

employing said triggering device to open a valve such that hydrostatic pressure is allowed to act on said pistons against an opposing lower pressure force to drive said pistons sequentially in setting said first and second tools.

18. The method of claim 17, comprising:

providing a hanger and a packer as said first and second tools.

19. A method of operating multiple tools with actuators therefor at a subterranean location, comprising:

running in, to a predetermined subterranean location, a tubular string on a running tool, said running tool connected adjacent a lower end of a running string;

mounting the multiple tools and actuators therefor exterior to said tubular string for said running in;

mounting a triggering device on said running tool for said running in;

sequentially setting said multiple tools with said triggering device with movement of said running tool relative to the tubular string triggering at least one of said multiple tools to set;

releasing from said tubular string and removing said running tool and running string from the subterranean location;

communicating a setting signal for setting said multiple tools through a wall of said tubular string that lacks penetrations.

* * * * *